US008246131B2

(12) United States Patent
Cheng et al.

(10) Patent No.: US 8,246,131 B2
(45) Date of Patent: Aug. 21, 2012

(54) INKJET PRINTER

(75) Inventors: Chen-Hsing Cheng, Tu-Cheng (TW); Tsung-Yu Hung, Tu-Cheng (TW); Ching-Ho Wei, Tu-Cheng (TW); Chang-Chin Wu, Tu-Cheng (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 341 days.

(21) Appl. No.: 12/648,487

(22) Filed: Dec. 29, 2009

(65) Prior Publication Data

US 2011/0096109 A1 Apr. 28, 2011

(30) Foreign Application Priority Data

Oct. 27, 2009 (CN) ..... 2009 1 0308874

(51) Int. Cl.
*B41J 29/38* (2006.01)

(52) U.S. Cl. ..... 347/6
(58) Field of Classification Search ..... 347/6, 7, 347/84–86
See application file for complete search history.

(56) References Cited

U.S. PATENT DOCUMENTS 6,145,954 A * 11/2000 Moore ..... 347/28
* cited by examiner

*Primary Examiner* — An Do
(74) *Attorney, Agent, or Firm* — Altis Law Group, Inc.

(57) ABSTRACT

An inkjet printer includes an inkjet cartridge, an inkjet head, a controller, a viscosity adjustment device and a viscometer. The inkjet cartridge is filled with ink. The inkjet head is connected to the inkjet cartridge. The catcher plate is opposite to the inkjet head, and connected to the cartridge. The viscometer is configured for determining a viscosity of ink in the inkjet cartridge. The viscosity adjustment device is configured for adjusting viscosity of ink in the inkjet cartridge. The controller is electrically connected to the inkjet head, the viscometer, and the viscosity adjustment device, respectively.

16 Claims, 2 Drawing Sheets

INKJET PRINTER

BACKGROUND

1. Technical Field

The present disclosure relates generally to inkjet printers and, more particularly, to an inkjet printer with a recovery device.

2. Description of Related Art

When inkjet printers print, excess ink may be ejected without reaching the medium. Thus, many inkjet printers often utilize a recovery device.

A commonly used inkjet printer includes a controller, an inkjet head, an inkjet cartridge, a recovery gutter or catcher, and a recovery reservoir. The controller directs the inkjet head to draw ink from the inkjet cartridge. The recovery gutter or catcher and the recovery reservoir are positioned below the inkjet head, and the recovery gutter is connected to the recovery reservoir via a plurality of conduits. Spray area of the inkjet head is less than the surface area of the recovery gutter. When the inkjet head sprays, ink not reaching the medium is gathered by the recovery gutter/catcher, and then flows to the recovery reservoir.

However, the ink is volatile and the viscosity thereof increases easily, such as when the ink flows to the recovery reservoir. Accordingly, the viscosity of the recovered ink needs to be adjusted by adding solvent, thereby complicating the process.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
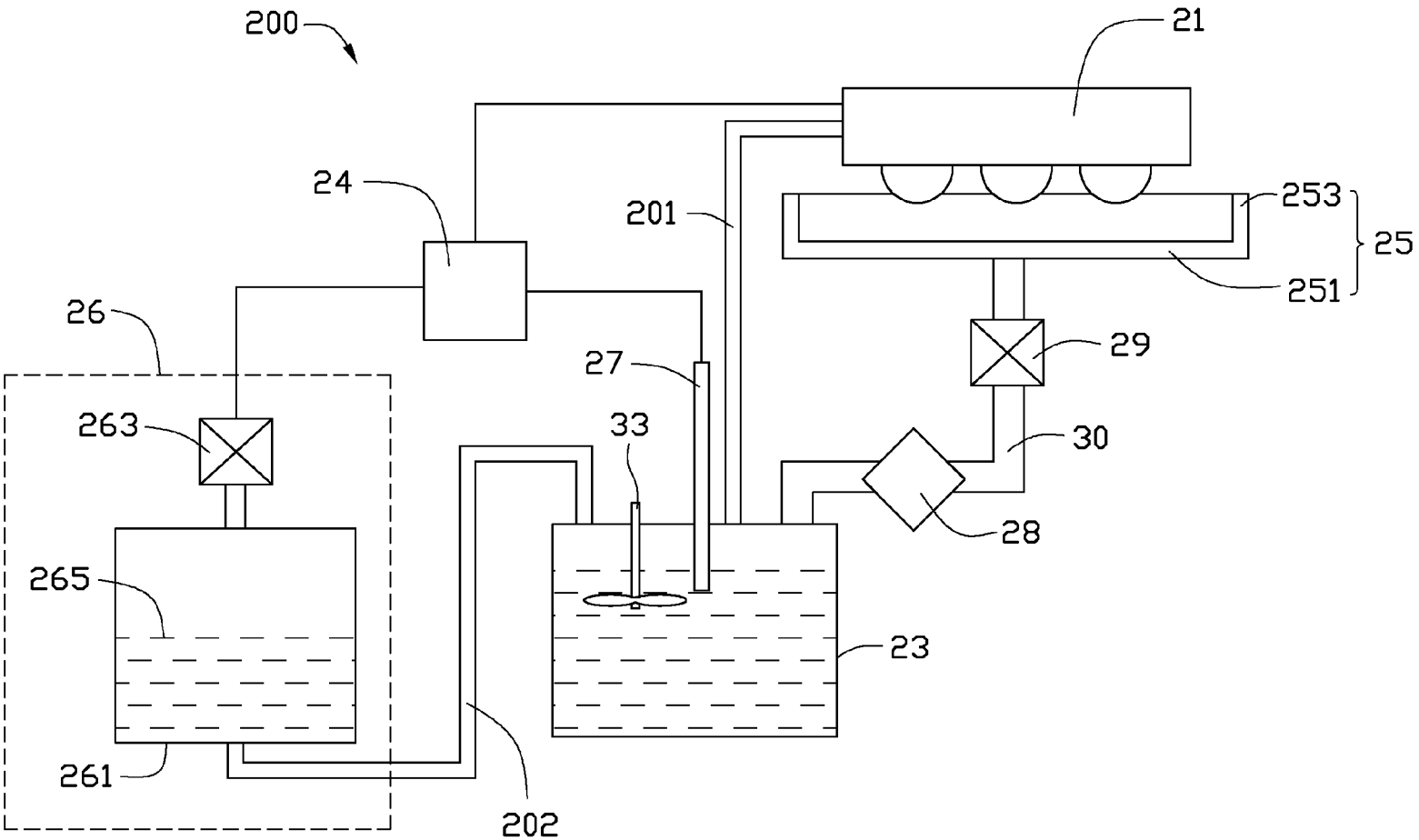
FIG. 1 is a schematic of a first embodiment of an inkjet printer.

Referring to FIG. 1, a first embodiment of an inkjet printer 200 includes an inkjet head 21, an inkjet cartridge 23, a controller 24, a catcher plate 25, a viscosity adjustment device 26, a viscometer 27, a filter 28, a first pump 29, and a blender 33.

The controller 24 is connected to the inkjet head 21. The inkjet head 21 is connected to the inkjet cartridge 23 via a first conduit 201. The controller 24 directs the inkjet head 21 to draw ink from the inkjet cartridge 23, and spray the ink onto media (not shown).

The catcher plate 25 is located opposite to the inkjet head 21 in the same direction as the ink spray to the media, and connected to the inkjet cartridge 23 via a connecting conduit 30. The catcher plate 25 includes a circular main body 251 and a plate edge 253 extending from the edge of the main body 251. Spray area of the inkjet head 21 is less than the surface area of the catcher plate 25. Thus, ink not reaching the media can be recovered by the catcher plate 25, and flows to the inkjet cartridge 23 via the connecting conduit 30.

The first pump 29 is fixed on the connecting conduit 30 and adjacent to the catcher plate 25, such that the recovery ink quickly reaches the connecting conduit 30 and then to the ink cartridge 23 due to the drawing force of the first pump 29. The filter 28 is also fixed on the connecting conduit 30 and adjacent to the inkjet cartridge 23, to filter out impurities from the recovered ink. In this illustrated embodiment, the first pump 29 is closer to the catcher plate 25 than the filter 28.

The viscometer 27 is positioned in the inkjet cartridge 23, and electrically connected to the controller 24. The viscometer 27 is configured for determining a viscosity of the ink stored in the inkjet cartridge 23, and transmitting information including the determined viscosity of the ink to the controller 24. In this illustrated embodiment, the viscometer 27 can be a rotary viscometer, ultrasonic viscometer or capillary viscometer.

The viscosity adjustment device 26 includes an adjustment tank 261 and a second pump 263 connected thereto. The second pump 263 is an air pump. The adjustment tank 261 is filled with a viscosity modifier 265. The second pump 263 is electrically connected to the controller 24. The adjustment tank 261 is connected to the inkjet cartridge 23 via a second conduit 202. When the second pump 263 is started by the controller 24, air pressure inside the adjustment tank 261 increases, such that the viscosity modifier 265 is drawn to the inkjet cartridge 23 through the second conduit 202. When the second pump 263 shuts off, the air pressure inside the adjustment tank is substantially equal to that of the inkjet cartridge 23, and the viscosity modifier 265 can no longer flow to the inkjet cartridge 23.

The blender 33 is configured for agitating ink in the inkjet cartridge 23, continuing to do so when the inkjet head 21 sprays ink. The blender 33 can also be used to thoroughly blend the viscosity modifier 265 with the ink, thereby improving the overall consistency and uniformity.

In use, a threshold viscosity of the ink is previously set in the controller 24, and the inkjet head 21 sprays ink. Obviously, excess viscosity creates difficulties in printing. Therefore, the threshold viscosity may be a maximum allowable value of viscosity. Ink gathered by the catcher plate 25 flows to the connecting conduit 30 drawn by the first pump 29, and enters the inkjet cartridge 23 after filtration by the filter 28. The controller 24 continuously determines the viscosity of the ink in the inkjet cartridge 23 for comparison with the threshold viscosity. If the measured viscosity is less than the threshold viscosity, the second pump 263 is not turned on. If the measured viscosity exceeds the threshold viscosity, the controller 24 activates the second pump 263, and the viscosity modifier 265 is introduced into the inkjet cartridge 23. The second pump 263 then shuts down until the measured viscosity returns to less than the threshold viscosity.

Figure 2:
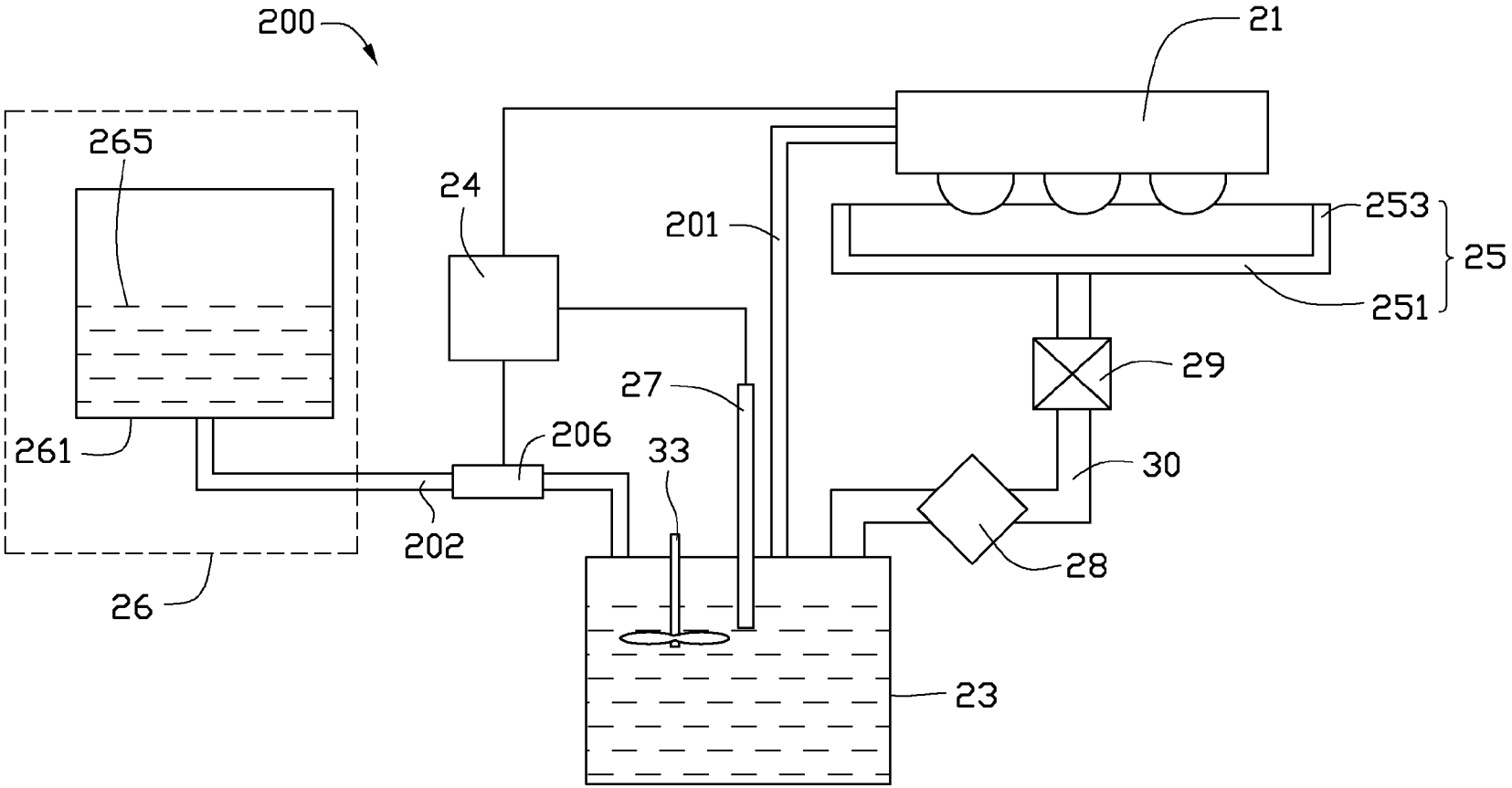
FIG. 2 is a schematic of a second embodiment of an inkjet printer.

Referring to FIG. 2, in a second embodiment, the second pump 263 can be omitted, and a switch 206 is fixed on the second conduit 202. The switch 206 is in the form of a solenoid valve. The second conduit 202 connects the adjustment tank 261 to the inkjet cartridge 23, and the switch 206 is electrically connected to the controller 24. The adjustment tank 261 is positioned above the inkjet cartridge 23, such that the viscosity modifier 265 inside the adjustment tank 261 is gravity-fed to the inkjet cartridge 23. When the switch 206 is activated, the viscosity modifier 265 inside the adjustment tank 261 flows to the inkjet cartridge 23.

Since the controller 24 initializes the second pump 263 to adjust the ink viscosity for the ink inside the inkjet cartridge 23, ink adjustment is fully automated. Additionally the viscosity adjustment is fully accomplished without undue exposure of the ink to the outside environment, helping to prevent undue increases in viscosity caused thereby.

It is believed that the present embodiments and their advantages will be understood from the foregoing description, and it will be apparent that various changes may be made thereto without departing from the spirit and scope of the disclosure or sacrificing all of its material advantages.

What is claimed is:

1. An inkjet printer, comprising:

an inkjet cartridge filled with ink;

an inkjet head connected to the inkjet cartridge;

a catcher plate opposite to the inkjet head and connected to the inkjet cartridge, the catcher plate being configured to recover ink sprayed out of the inkjet head;

a viscometer for determining a viscosity value of ink in the inkjet cartridge;

a viscosity adjustment device for adjusting viscosity of ink in the inkjet cartridge; and a controller electrically connected to the inkjet head, the viscometer and the viscosity adjustment device, respectively.

2. The inkjet printer of claim 1, wherein the viscosity adjustment device comprises an adjustment tank and a second pump connected to the adjustment tank, wherein the second pump is electrically connected to the controller and the adjustment tank is connected to the inkjet cartridge via a conduit.

3. The inkjet printer of claim 1, wherein the catcher plate is connected to the inkjet cartridge via a connecting conduit, and a first pump is fixed on the connecting conduit and between the catcher plate and the inkjet cartridge.

4. The inkjet printer of claim 3, wherein the inkjet printer further comprises a filter fixed on the connecting conduit and adjacent to the inkjet cartridge.

5. The inkjet printer of claim 1, wherein the catcher plate includes a main body and a plate edge extending from an edge thereof.

6. The inkjet printer of claim 1, further comprising a blender for agitating ink in the inkjet cartridge.

7. The inkjet printer of claim 1, wherein the viscometer is a rotary viscometer, an ultrasonic viscometer, or a capillary viscometer.

8. The inkjet printer of claim 1, wherein the viscosity adjustment device comprises an adjustment tank, and a switch connected thereto, the switch electrically connected to the controller and the adjustment tank is positioned above the inkjet cartridge and connected to the inkjet cartridge via a conduit.

9. An inkjet printer, comprising:

an inkjet cartridge filled with ink;

an inkjet head connected to the inkjet cartridge;

a catcher plate opposite to the inkjet head, and connected to the inkjet cartridge, the catcher plate being configured to recover ink sprayed out of the inkjet head;

a controller electrically connected with the inkjet head; and wherein the inkjet printer further comprises a viscosity adjustment device and a viscometer, the viscosity adjustment device and the viscometer electrically connected to the controller, wherein a threshold viscosity of ink is set in the controller, the viscometer tests a viscosity value of ink in the inkjet cartridge, and the viscosity adjustment device is filled with the viscosity modifier;

wherein after comparison by the controller, if the measured viscosity exceeds the threshold viscosity, the viscosity adjustment device is activated, transferring the viscosity modifier to the inkjet cartridge to adjust the viscosity of ink in the inkjet head.

10. The inkjet printer of claim 9, wherein the viscosity adjustment device comprises an adjustment tank and a second pump connected thereto, the second pump electrically connected to the controller, and the adjustment tank connected to the inkjet cartridge via a conduit.

11. The inkjet printer of claim 9, wherein the catcher plate is connected to the inkjet cartridge via a connecting conduit and a first pump is fixed on the connecting conduit and between the catcher plate and the inkjet cartridge.

12. The inkjet printer of claim 11, wherein the inkjet printer further comprises a filter fixed on the connecting conduit and adjacent to the inkjet cartridge.

13. The inkjet printer of claim 9, wherein the catcher plate includes a main body and a plate edge extending from an edge thereof.

14. The inkjet printer of claim 9, further comprising a blender for agitating ink in the inkjet cartridge.

15. The inkjet printer of claim 9, wherein the viscometer is a rotary viscometer, an ultrasonic viscometer, or a capillary viscometer.

16. The inkjet printer of claim 9, wherein the viscosity adjustment device comprises an adjustment tank and a switch connected to the adjustment tank, wherein the switch is electrically connected to the controller and the adjustment tank is positioned above the inkjet cartridge and connected to the inkjet cartridge via a conduit.

* * * * *